US005169154A

United States Patent [19]

Borghi

[11] Patent Number: 5,169,154

[45] Date of Patent: Dec. 8, 1992

[54] CASINO BOARD GAME

[76] Inventor: Dianne Borghi, 9 McCarthy Cir., Framingham, Mass. 01701

[21] Appl. No.: 707,827

[22] Filed: May 30, 1991

[51] Int. Cl.[5] ..... A63F 3/00

[52] U.S. Cl. ..... 273/256; 273/274

[58] Field of Search ..... 273/274, 256, 243

[56] References Cited

U.S. PATENT DOCUMENTS

| | | | |
|---|---|---|---|
| 3,759,520 | 9/1973 | Straitwell | 273/243 |
| 3,889,954 | 6/1975 | Malisow | 273/274 |
| 4,842,281 | 6/1989 | Turner | 273/256 |
| 4,887,819 | 12/1989 | Walker | 273/274 |

*Primary Examiner*—Benjamin H. Layno
*Attorney, Agent, or Firm*—John P. McGonagle

[57] ABSTRACT

A board game is disclosed which includes a game board with marked spaces constituting a path of progression about the board. A number of the spaces are designated for various leased game spaces. A plurality of special cards are also provided, each card uniquely indicating the lease ownership of a particular leased game. The remaining spaces are designated for certain reward/penalty functions and game spaces which may not be leased. Playing pieces, money chips, special playing cards, a special die and various individual reward/penalty fortune cards are also included to determine penalties, payments or benefits to be accrued to a player whose playing piece comes to rest upon a particular location which may be leased or is a reward/penalty location. Dice are provided to determine the movement of each player's playing piece along the progression of spaces on the board. Letter cards to the word CA$INO are provided, which letters may be purchased at various designated times during play. The first player to purchase sufficient letters to spell CA$INO wins the game.

10 Claims, 6 Drawing Sheets

FIG. 5A
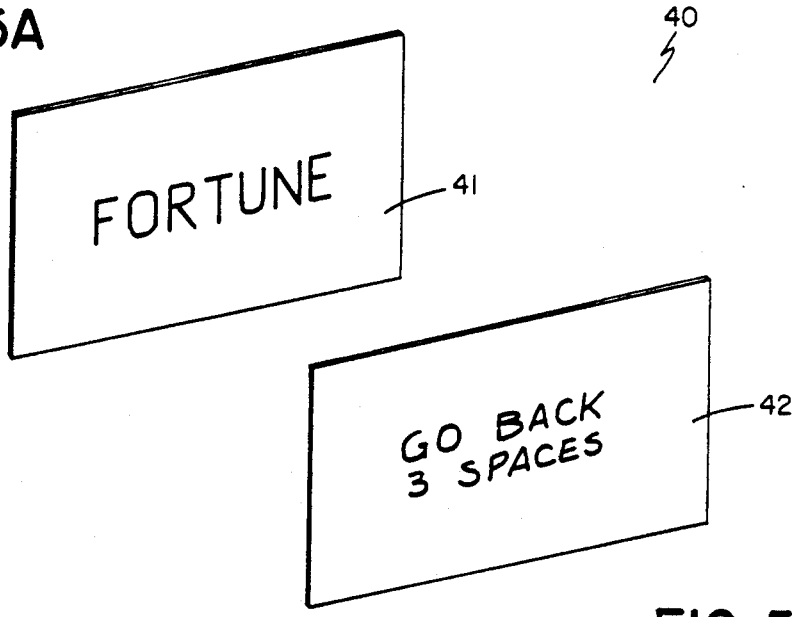
FIG. 5B
FIG. 6A
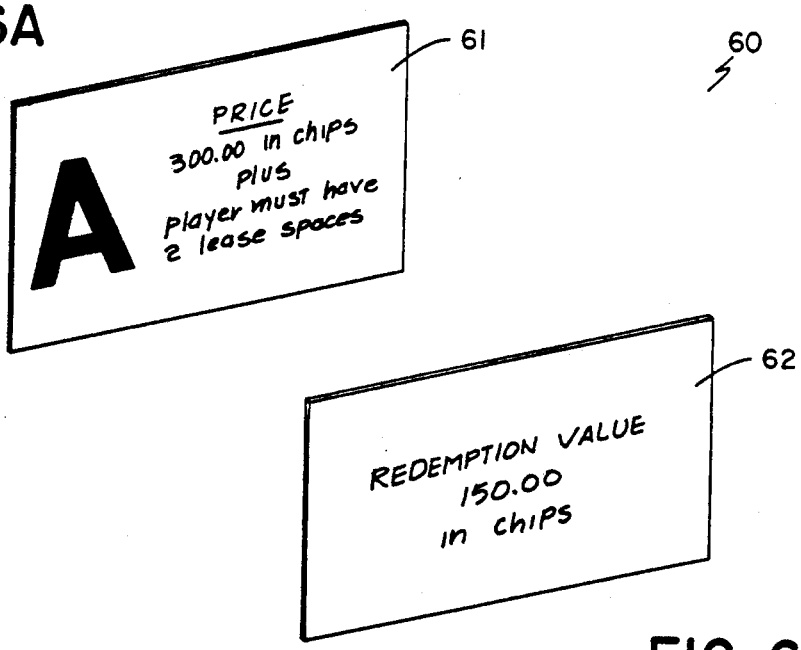
FIG. 6B

GOLDEN CARD PALACE

WIN AMOUNT - 25.00 IN CHIPS
LOSE AMOUNT - 100.00 IN CHIPS

ALL WIN OR LOSE AMOUNTS ARE PAID BY THE PLAYER LANDING ON THE SPACE TO THE PLAYER LEASING THE SPACE.

LEASE FEE: 30.00 IN CHIPS
BROKEN LEASE VALUE: 200.00 IN CHIPS

70

FIG. 7

CA$INO MANAGER CARD

PEACOCK CLUB
FLAMINGO CLUB
BUTTERFLY CLUB
TIGER CLUB

WIN AMOUNT - NO CHIPS DUE
LOSE AMOUNT - 50.00 IN CHIPS

ALL LOSE AMOUNTS ARE PAID BY THE PLAYER LANDING ON THE SPACE TO THE PLAYER THAT IS THE CA$INO MANAGER.

80

FIG. 8

THE GAMES

CARDS TWENTY-TWO (22) DICE

90

CARDS

This game is played at CARD PALACE SPACES. All the games are played between the player landing on the space and the player leasing the space.

After shuffling the SPECIAL CARD DECK, 3 cards are dealt to the player landing on the space and the player leasing the space. The player with the highest total of the 3 cards is the winner. If the player landing on the space loses he must pay in chips the lose amount to the player leasing the space. If the player landing on the space wins he must pay in chips the win amount to the player leasing the space.

DICE

This game is played at DICE ROOM SPACES. All the games are played between the player landing on the space and the player leasing the space.

The player landing on the space throws the SPECIAL DIE. If he throws: 7, 11, or Blank he wins. If the player landing on the space throws: 2, 3, or 12 he loses. If the player landing on the space loses he must pay in chips the lose amount to the player leasing the space.

TWENTY-TWO (22)

This game is played at (22) TABLE SPACES. All the games are played between the player landing on the space and the player leasing the space.

After shuffling the SPECIAL CARD DECK, the player landing on the space and the player leasing the space are dealt cards from the deck. Each player must get as close to the total of 22 without going over that total. If he goes over the total he automatically loses. He may stop taking cards at any time. If neither player goes over the total of 22 then the player closest to the total wins. If there is a tie neither player wins or loses. If the player landing on the space wins he must pay in chips the win amount to the player leasing the space. If the player landing on the space loses he must pay in chips the lose amount to the player leasing the space.

CLUB SPACES

Any player landing on these spaces must play with the player that is the CA$INO MANAGER at the time. The player landing on these spaces has his choice of what game he would like to play (CARDS, DICE OR 22). If the plaayer landing on the space wins he pays nothing in chips. If the player landing on the space loses he must pay in chips the lose amount to the CA$INO MANAGER. The CA$INO MANAGER uses the green CA$INO MANAGERS card to determine the amount to be paid. The CA$INO MANAGER keeps these chips as his own. No Club Spaces can be leased.

FIG. 9

CASINO BOARD GAME

BACKGROUND OF THE INVENTION

The present invention relates generally to board games, and more particularly to a board game including leasing and chance.

With the increasing amounts of leisure time available to persons in modern society, an increasing need has been felt for amusement devices to occupy such leisure time. A selected class of such amusement devices has been generally favored as providing substantially non-repetitive play, requiring logic and intelligent decision making during play, and generally maintaining a high degree of interest for an extended period of time. Board games are within this selected class.

The present invention provides such a board game.

SUMMARY OF THE INVENTION

A preferred embodiment of the present invention includes a game board with marked spaces constituting a path of progression about the board. A number of the spaces are designated for various leased game spaces. A plurality of special cards are also provided, each card uniquely indicating the lease ownership of a particular leased game. The remaining spaces are designated for certain reward/penalty functions and game spaces which may not be leased.

Playing pieces are also provided with each piece uniquely representing or being associated with an individual player. Dice are provided as a first chance taking apparatus to determine the movement of each player's playing piece along the progression of spaces on the board. Special playing cards, a special die, and various individual reward/penalty fortune cards are also included to determine penalties, payments, or benefits to be accrued to a player whose playing piece comes to rest upon a particular location which may be leased or is a reward/penalty location.

Money chips are also provided so that a player whose playing piece comes to rest upon a particular lease game space may then, if it has not been previously leased, pay for lease ownership rights to that location. The chips are further used as a medium of complying with the rewards or penalties dictated by the fortune cards associated with the reward/penalty locations upon the game board and also for payments required by the games' lessors/managers of various locations due to losses or wins from games played at the various leased and nonleased game spaces.

In the event the playing piece of a player comes to rest upon a game space, the player must play a designated game of chance with the lessor/manager and pay an amount determined by the designated game results to said lessor/manager.

A plurality of letter cards to the word CA$INO are also provided, which letters may be purchased at various designated times during play. The first player to purchase sufficient letters to spell CA$INO wins the game.

It is, thus, a primary object of the present invention to provide a novel board game apparatus.

It is a further object of the present invention to provide such apparatus for allowing the play of a board game including leasing and chance.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIGS. 5A and 5B are front and rear perspective views of a FORTUNE-type card employed in the preferred embodiment;

FIGS. 6A and 6B are front and rear perspective views of a Letter-type card employed in the preferred embodiment;

FIG. 7 is a perspective view of a sample lease ownership card;

FIG. 8 is a perspective view of a CA$INO Manager Card; and

FIG. 9 is a perspective view of a Description of Games Sheet.

DETAILED DESCRIPTION OF THE INVENTION

Figure 1:
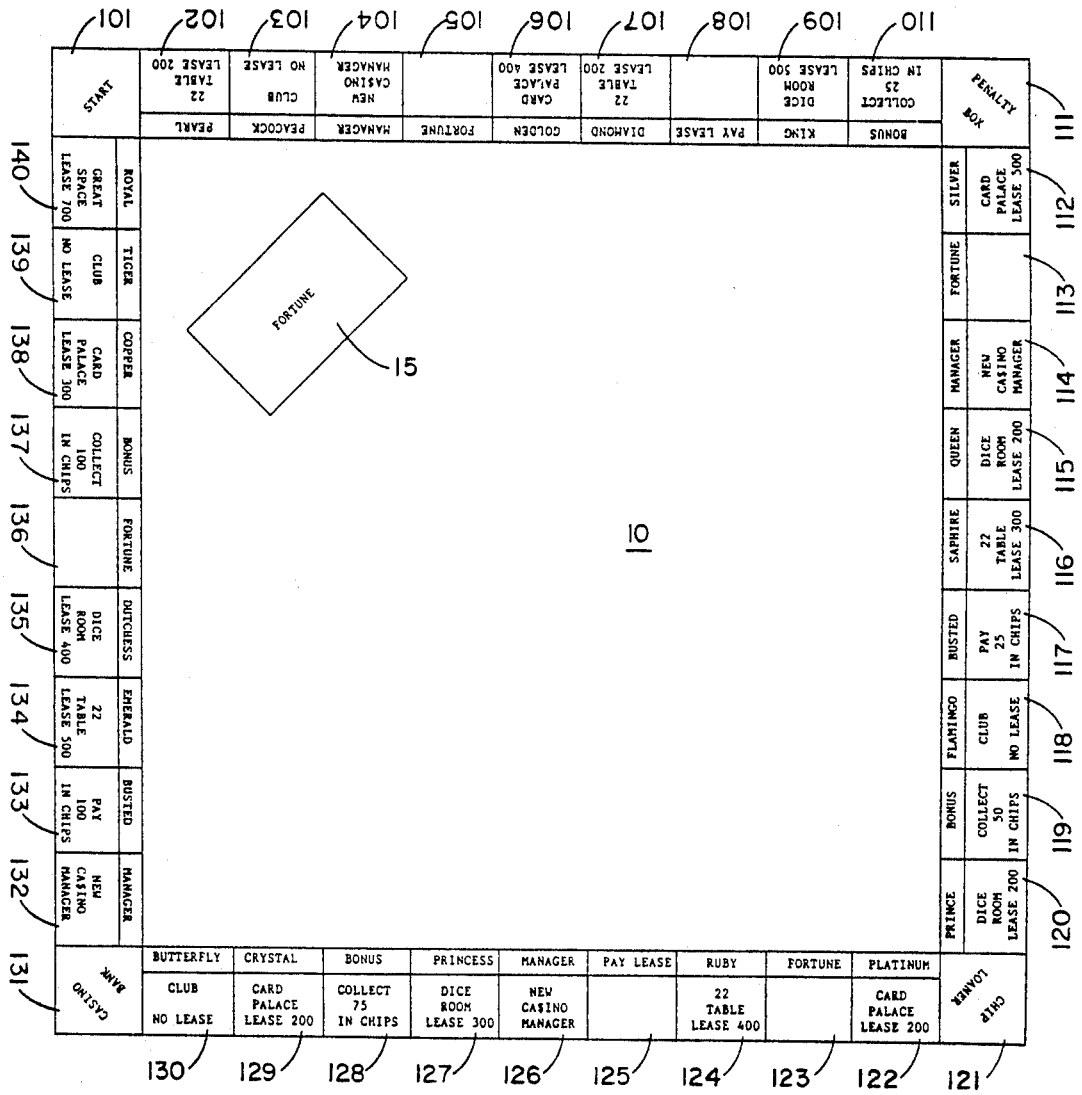
FIG. 1 is a top plan view of a preferred embodiment of the playing board of the present invention.
Figure 2:
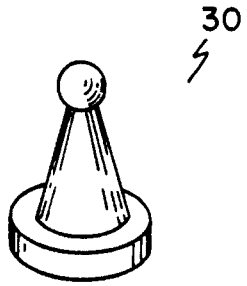
FIG. 2 is a perspective view of a playing piece.
Figure 3:
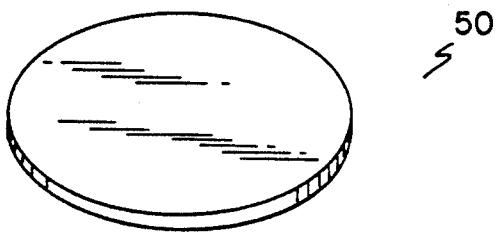
FIG. 3 is a perspective view of a sample money chip.
Figure 4:
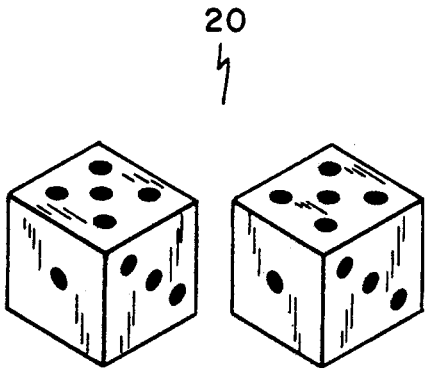
FIG. 4 is a perspective view of a pair of dice employed in the preferred embodiment.
Figure 10:
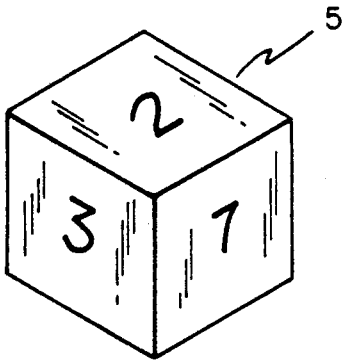
FIG. 10 is a perspective view of the special die employed in the preferred embodiment.
Figure 11:
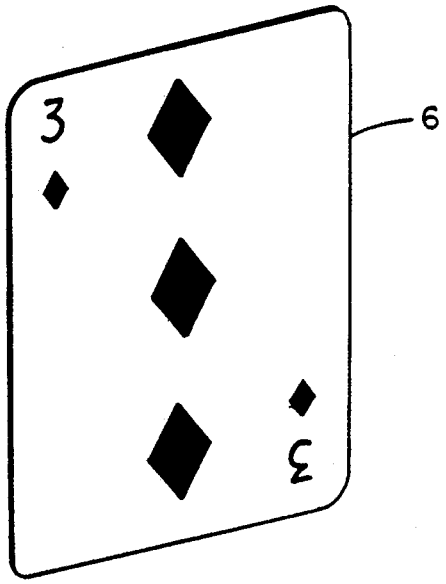
FIG. 11 is a perspective view of a special playing card employed in the preferred embodiment.

Referring to the drawings in detail wherein like elements are indicated by like numerals, the apparatus of the present invention comprises a game board 10 shown in FIG. 1; a plurality of playing pieces 30, an example of which is shown in FIG. 2; money value chips 50, an example of which is shown in FIG. 3; a random number generating means such as a pair of dice 20 shown in FIG. 4; a plurality of FORTUNE cards 40, an example of which is shown in FIGS. 5A and 5B; a plurality of letters 60 to the word CA$INO, an example of which is shown in FIGS. 6A and 6B; a plurality of Lease Ownership Cards 70, an example of which is shown in FIG. 7; and a Manager's Card 80, an example of which is shown in FIG. 8. Also included are a Description of Games Sheet 90 shown in FIG. 9; a special die 5 shown in FIG. 10; special playing cards 6, an example of which is shown in FIG. 11; and a set of rules which may be printed and which serve as a means by which the game is dictated.

FIG. 1 is a top plan view of the playing board 10 of the present invention illustrating the plurality of marked playing spaces 101–140 disposed along the periphery of the playing board 10. The preferred embodiment of the playing board 10 is formed in a square shape. The board 10 is made of a durable material and may optionally be folding to conserve space when not in use. The dice 20 dictate how many spaces a player is to move a playing piece 30 during a turn. The playing pieces 30 are differentiated from one another by color or structure or other appropriate means. Each player uses only one playing piece 30. The spaces 101–140 defined on the game board 10 support the playing pieces 30 during movement. With each number generated by one or more of the dice 20, each playing piece 30 advances a conforming number of spaces. The movement of each playing piece 30 according to the number generated by one roll of the dice 20 defines one turn. The players move their playing pieces 30 in rotation. When the playing piece 30 terminates movement on a space, certain opportunities, games or reward/penalties are designated.

Marked playing spaces that are numbered 102, 106, 107, 109, 112, 115, 116, 120, 122, 124, 127, 129, 134, 135, 138 and 140 designate specific games, i.e., "22", "Dice" or "Cards", which may be leased from the CA$INO Bank upon payment of a designated amount of money chips 50. The said game spaces are further defined by colors. The "22" game spaces 102, 107, 116, 124 and 134 have a yellow color associated with each, such as a yellow border, strip, lettering or entire space. The Dice game spaces 109, 115, 120, 127 and 135 have a purple color associated with each, such as a purple border, strip, lettering or entire space. The Cards game spaces 106, 112, 122, 129 and 138 have a blue color associated with each, such as a blue border, strip, lettering or entire space. Other colors and color combinations may be used in other embodiments of the invention. Each said space has a Lease Ownership Card 70 associated with it. In this embodiment of the invention, the Lease Ownership Cards 70 have the same color as the color associated with the particular lease game space.

Marked playing spaces 105, 113, 123 and 136 are FORTUNE spaces which have FORTUNE cards 40 associated with them which indicate varied reward-/punishment, opportunities and/or directions in accordance with the rules of the game. Other special spaces on the board 10 are START space 101 which is the space upon which all players begin the game; CA$INO MANAGER spaces 104, 114, 126 and 132 which designate a change in management of CLUB spaces; CLUB spaces 103, 118, 130 and 139 which designate nonleasable CLUB game spaces; PAY LEASE spaces 108 and 125 which direct payment from player, i.e., any player landing on one of these spaces must pay the CA$INO BANK the lease fee, which is printed on each Lease Ownership Card 70, for each of his leased properties; CA$INO BANK space 131 which directs payment to player, i.e., every time a player passes this space he may collect $100 in chips from the CA$INO BANK; PENALTY BOX space 111 which prevents player from participating in games, i.e., when a player lands on this space he cannot participate in any games of CARDS, DICE or "22" with any other player until he leaves the PENALTY BOX space; CHIP LOANER space 121 which directs payment to player, i.e., any player landing on this space collects $25 in chips from the CA$INO BANK; BONUS spaces 110, 119, 128 and 137 which direct payment to player, i.e., any player landing on one of these spaces collects from the CA$INO BANK the designated amount of chips; BUSTED spaces 117 and 133 which direct payment from player, i.e., any player landing on one of these spaces must pay to the CA$INO BANK the designated amount in chips.

As stated above FORTUNE cards 40 are utilized in the game. Each card 40 is made of a durable material, such as a light weight cardboard. On the card's front side 41 the word FORTUNE is printed. Printed on the card's reverse side 42 is a description of a particular reward/penalty/instruction designated for the player drawing a card during a particular turn. In this particular embodiment of the invention thirty fortune cards 40 are used and the printed descriptions on the reverse sides 42 of the cards are as follows:

FORTUNE CARDS

1. DO NOT PAY LEASE FEE NEXT TIME YOU LAND ON THE LEASE FEE SPACE. KEEP CARD UNTIL USED.
2. MOVING FORWARD GO TO THE START SPACE. DO NOT COLLECT ANY CHIPS.
3. GO TO CA$INO BANK SPACE AND COLLECT $50 IN CHIPS; AS YOU PASS THIS SPACE COLLECT THE REGULAR $100 IN CHIPS NORMALLY DUE YOU.
4. PAY THE CAS$NO BANK $50 IN CHIPS.
5. PAY THE CA$INO BANK $25 IN CHIPS.
6. CONGRATULATIONS! YOU ARE THE NEW CA$INO MANAGER.
7. DO NOT COLLECT ANY CHIPS ON YOUR LEASED SPACES UNTIL YOUR TURN AGAIN. NO GAMES PLAYED.
8. GO BACK 3 SPACES.
9. GO AHEAD 3 SPACES.
10. ADVANCE 4 SPACES.
11. GO TO THE START SPACE AND COLLECT $20 IN CHIPS FROM EVERY PLAYER.
12. TAKE ANOTHER TURN.
13. GO TO THE CHIP LOANER SPACE AND COLLECT $100 IN CHIPS FROM CA$INO BANK.
14. ADVANCE TO THE NEXT CARD PALACE.
15. ADVANCE TO THE NEXT DICE ROOM.
16. ADVANCE TO THE NEXT 22 TABLE.
17. THERE WAS A MISTAKE AT THE CHIP LOANER, PAY THE CA$INO BANK $50 IN CHIPS.
18. ADVANCE TO THE CA$INO BANK AND COLLECT $50 IN CHIPS. DO NOT COLLECT $100 IN CHIPS NORMALLY DUE YOU.
19. ADVANCE TO THE NEXT PAY LEASE SPACE AND PAY LEASE FEES FOR ALL YOUR LEASED SPACES.
20. YOUR DICE ARE BAD, PAY EACH PLAYER $50 IN CHIPS.
21. YOU ARE THE NEW CA$INO MANAGER.
22. YOU ARE THE NEW CA$INO MANAGER.
23. THE CA$INO MANAGER HAD A NERVOUS BREAKDOWN, TAKE HIS PLACE.
24. YOU HAVE JUST FINISHED TRAINING FOR CA$INO MANAGER, SPLIT ALL HIS CLUB WINNINGS UNTIL YOUR TURN AGAIN.
25. GO TO THE PENALTY BOX.
26. GO TO THE CHIP LOANER SPACE.
27. GO TO THE NEXT CA$INO MANAGER SPACE.
28. GO TO THE NEXT CLUB SPACE.
29. PAY A $20 FEE TO THE CA$INO BANK FOR EVERY LETTER OF THE WORD CA$INO THAT YOU OWN.
30. GO TO ANY SPACE YOU DESIRE.

When used during playing of the game, the FORTUNE cards 40 are randomly shuffled and placed in a stack with their reverse sides 42 down on the FORTUNE card position 15 on the game board 10. Upon a playing piece 30 terminating movement on a FORTUNE space 105, 113, 123 or 136 the player selects the topmost FORTUNE card 40 in the stack and follows its instructions. The shuffled stack of FORTUNE cards 40 serves as a means for randomly supplying one of a plurality of FORTUNE card rewards/punishments/directions. The FORTUNE card 40 is placed reverse side 42 down at the bottom of the stack after it is viewed, or retained if so indicated.

Money value chips 50 are used as a medium of exchange for all financial transactions in the game. In this embodiment, colors are used on the chips 50 to establish and differentiate values. Specifically, a red chip is defined as having a value of $500; white $100; blue $50; green $25; and yellow $10. At the start of each game, $1,250 in chips is issued to each player. In other embodiments, the values may be changed. In other embodiments, other mediums of exchange may be used, such as paper money.

The object of the game is to earn enough money (chips 50) to buy the word CA$INO in accordance with the rules of the game. To that end, a plurality of letter-cards 60 to the word CA$INO are utilized. Each letter-card 60 is imprinted on a card made of durable material, such as a lightweight cardboard. On the front 61 of the card 60 a particular letter or symbol C, A, $, I, N or O is imprinted, along with the price and conditions of purchase. The reverse side 62 of the card 60 has redemption values imprinted. In this embodiment of the game, twenty-six letter-cards 60 are used, five of each letter and one of the symbol $. In this embodiment of the game, the letter-card for $ may only be purchased by a player holding at least one of each of the letters C, A, I, N and O. The letter-cards 60 are held by the bank until purchased, and then are held by the purchasing player unless redeemed back to the bank.

As stated above the board marked playing spaces 102, 106, 107, 109, 112, 115, 116, 120, 122, 124, 127, 129, 134, 135, 138 and 140 designate games which may be leased from the CA$INO Bank upon payment of a designated amount of money chips 50. Each said space has a color coordinated Lease Ownership Card 70 associated with it. If a player's token 30 lands on one of these spaces, the particular game space may be leased from the bank by the player for the designated lease fee. The player then pays the bank in chips 50 the lease amount printed on the particular game space. Once a space is leased by a player, any other player landing on that space must play a game of CARDS, DICE, or "22" (described below) with the player leasing the space. The player leasing the space always gets paid either the WIN AMOUNT or LOSE AMOUNT printed on the Lease Ownership Card 70 by the player landing on that game space. If the player landing on the space wins the particular game, he pays the lessor in chips the WIN AMOUNT. If he loses the game, he pays the LOSE AMOUNT. A game lease owner may, at his turn, sell a particular lease back to the bank for the BROKEN LEASE VALUE imprinted on the Lease Ownership Card. The game space can then be leased again from the bank by any player landing on it. Each of the Lease Ownership Cards 70 are held by the bank until leased by a player. Any player who has leased a space must pay the LEASE FEE imprinted on the Lease Ownership Card 70 when he lands on a board PAY LEASE space 108, 125.

Space 140 is also designated the Royal Great Space. Any player landing on this space may lease it if it is not already leased. If it is leased, the player landing on the space has a choice of playing a game of DICE, "22", or CARDS with the player leasing the space 140. However, the player landing on the space is playing for all the other players also. If he wins, all the players pay the WIN amount to the player leasing the space 140. If the player landing on the space loses, none of the other players pay anything, only the player himself pays the LOSE amount to the player leasing the space.

The CLUB spaces 103, 118, 130 and 139 cannot be leased. The player designated as CA$INO Manager manages these spaces and also takes care of the CA$INO Bank. The player designated as CA$INO Manager changes throughout the game. Any player landing on a CLUB space 103, 118, 130 or 139 must play a game of Cards, Dice or "22" with the player that is the CA$INO Manager at the time. The player landing on a CLUB space 103, 118, 130 or 139 chooses the particular game. The Description Of Games Sheet 90 specifies how each said game is played. If the player landing on the CLUB space wins the game played, he pays nothing. If the player landing on the CLUB space loses, he must pay in chips the lose amount for that particular CLUB space and game played to the CA$INO Manager. The CA$INO Manager's Card 80 determines the amounts paid. The CA$INO Manager keeps these chips.

The initial CA$INO Manager is designated at the start by the player throwing dice 20 with the highest total and he also starts the game and takes care of the bank. Whenever a player throws dice during the game totalling twelve, that player automatically becomes the new CA$INO Manager. If a player lands on a FORTUNE space 105, 113, 123 or 136 and draws FORTUNE card #6, #21, #22, #23 or #27, the player becomes the new CA$INO Manager. If a player lands on board space 104, 114, 126 or 132, the player becomes the new CA$INO Manager. If the CA$INO Manager cannot pay his debts or is out of the game for any other reason, the next new CA$INO Manager is determined by a special roll of the dice. The player with the highest roll is the next new CA$INO Manager. Play of the game resumes where it was left off before the new CA$INO Manager was selected.

The game is structured so that money chips 50 are primarily earned by leasing game spaces on the board 10 from the CA$INO Bank and then playing a designated game of Cards, Dice or "22" with any other player who lands on the leased spaces. The player leasing the space is always paid by the player landing on the space. The player landing on the space pays the WIN AMOUNT or the LOSE AMOUNT depending if he has won or lost the particular game that was being played. All the games to be played are listed and explained on the Description Of Games Sheet 90.

CARD games are played with the special playing cards 6 at Card Palace spaces 106, 112, 122, 129, 138, and optionally at CLUB spaces 103, 118, 130, 139, and the Royal Great Space 140. All the CARD games are played between the player landing on the space and the player leasing or managing the particular space. After shuffling the deck of special playing cards 6, three cards are dealt to the player landing on the space and the player leasing the space. The player with the highest total of the three cards is the winner. If the player landing on the space loses, he must pay in chips the lose amount to the player leasing or managing the space. If the player landing on the space wins, he must pay in chips the win amount to the player leasing or managing the space. The special playing cards are numbered one through ten for each of three suits, i.e., spades, clubs and diamonds.

DICE games are played with the special die 5 at the DICE Room spaces 109, 115, 120, 127, 135, and optionally at CLUB spaces 103, 118, 130, 139, and the Royal Great Space 140. All the DICE games are played between the player landing on the space and the player leasing or managing the particular space. The player landing on the particular space throws the special die 5. If he throws a "7", "11" or Blank he wins. If the player landing on the particular space throws a "2", "3" or "12", he loses. If the player landing on the particular space loses, he must pay in chips the lose amount to the player leasing or managing the particular space. If the player landing on the particular space wins, he must pay in chips the win amount to the player leasing or managing the particular space. The special die 5 has six sides, each side marked with one of the following: "2", "3", "7", "11", "12", or Blank.

"22" games are played with the special playing cards 6 at the "22" TABLE spaces 102, 107, 116, 124, 134, and optionally at CLUB spaces 103, 118, 130, 139, and the Royal Great Space 140. All the "22" games are played between the player landing on the space and the player leasing or managing the particular space. After shuffling the deck of special playing cards 6, the player landing on the particular space and the player leasing or managing the particular space are dealt cards from the deck. Each player must get as close to the total of "22" without going over that total. Either player may stop taking cards at any time. If a player goes over the total, he automatically loses. If neither player goes over the total of "22", then the player closest to the total wins. If there is a tie, no one wins or loses and no chips 50 are exchanged. If the player landing on the space wins, he must pay in chips the WIN amount to the player leasing or managing the space. If the player landing on the space loses, he must pay in chips the lose amount to the player leasing or managing the space.

OPERATION

The object of the game is to earn enough chips 50 to buy the word CA$INO. The game may be played more than one way. Before play begins, an anti may be decided upon among the players. Each player puts up the same anti. The first player to buy the word CA$INO wins all the anti. CA$INO can also be played with no anti and the first player to buy the word CA$INO wins the game.

Each player picks a playing piece 30 which represents his moves on the game board 10 and places it on the board START space 101. Each player is given the following in chips 50: one red worth $500 each; three white worth $100 each; five blue worth $50 each; six green worth $25 each; and five yellow worth $10 each. The total value of chips given to each player at the start is $1,250. Each player throws the dice 20. The player with the highest total starts the game and is also the first CA$INO MANAGER. Play moves clockwise about the board 10 with each player during his turn moving around the board 10 a number of spaces equal to the total number thrown on the dice 20. When a player lands on a space that he can lease, he has the option of leasing the space or not. If he lands on any other spaces, he must follow the rules according to the description given of that particular space.

A player earns chips 50 by leasing spaces on the board 10 from the CA$INO BANK and then playing a game of CARDS, DICE or "22" on the leased spaces with any other players who land on the leased spaces. The player leasing the space is always paid by the person landing on the space. The player landing on the space pays the WIN AMOUNT or the LOSE AMOUNT depending on whether he has won or lost the particular game that was being played. All the games to be played are listed and explained on the special Description of Games Sheet 90.

Spaces are leased as follows. If a player lands on a space that can be leased, he may lease it from the CA$INO BANK for the designated lease amount. The bank lease amounts are printed on the spaces on the board 10. The player then pays the CA$INO BANK in chips 50 the lease amount. Once a space is leased by a player, any other player landing on that space must play a game of CARDS, DICE or "22" with the player leasing the space. The player leasing the space is always paid either a WIN AMOUNT or a LOSE AMOUNT. If the player landing on the space wins he pays in chips the WIN AMOUNT to the player leasing the space. If the player landing on the space loses, he pays in chips 50 the LOSE AMOUNT to the player leasing the space. The WIN AMOUNT and the LOSE AMOUNT are listed on the Lease Ownership Cards 70. If a player decides he does not want a lease space anymore, he may, during his turn, sell it back to the CA$INO BANK for the BROKEN LEASE VALUE. However, if a player has any letters 60 to the word CA$INO, he must keep at least the minimum amount of leased spaces which qualified him to buy the letter 60. The lease spaces sold back to the CA$INO BANK may then be leased again according to the same procedure as though they had never been leased. All of the Lease Ownership Cards 70 are held by the CA$INO BANK until they have been leased. After each particular space is leased, the appropriate Lease Ownership Card 70 is given to the player who has leased the space. Any player who has leased spaces, must pay a lease fee for each lease when he lands on the PAY LEASE space 108 or 125.

The CLUB spaces 103, 118, 130 and 139 on the board 10 cannot be leased. The CA$INO MANAGER manages these spaces and collects for himself the LOSE AMOUNTS associated therewith. He also administers the CA$INO BANK. The CA$INO MANAGER changes throughout the game. Any player landing on a CLUB space 103, 118, 130 or 139 must play a game of CARDS, DICE or "22" with the CA$INO MANAGER. The player landing on one of these spaces has the choice of what is to be played. If the player landing on the space wins he pays nothing in chips 50. If the player landing on the space loses, he must pay in chips 50 the LOSE AMOUNT to the CA$INO MANAGER. The CA$INO MANAGER uses a green CA$INO MANAGER'S CARD 80 to determine the amount to be paid. The CA$INO MANAGER keeps these chips 50 as his own. The CLUB Spaces 103, 118, 130 and 139 can not be leased.

As stated above, there are four ways of changing the CA$INO MANAGER. The first is by a player throwing a 12 on the dice 20. The second is a FORTUNE Card giving a player that position. The third is by landing on board space 104, 114, 126 or 132 which gives the landing player the position. The fourth is if the CA$INO MANAGER cannot pay his debts or is out of the game for any other reason. The next new CA$INO MANAGER is determined by a special roll of the dice 20. The player with the highest roll is the next new CA$INO MANAGER. Play of the game resumes where it left off before the new CA$INO MANAGER was determined.

A player must always have at least two leased spaces in his possession before he may consider buying a letter 60 in the word CA$INO. When a player earns enough chips 50 to buy a letter 60 in the word CA$INO, he may do so when it is his turn. He may only purchase one letter 60 at a time. There are five of each letter except the symbol $, of which there is only one. A player must have one of each letter 60 of the word CA$INO before he is allowed to purchase the symbol $. The letters may be purchased in any order the player wishes when it is his turn. A player may also redeem one or more letters 60 into the CA$INO BANK during his turn for the redemption value printed on the letter card 60.

If a player cannot pay another player what he owes to another player, he must first sell any letter or letters of the word CA$INO he has purchased back to the CA$INO BANK for the Letter Redemption Value printed on the reverse side 62 of the letter card 60. If selling the letters to the word CA$INO are not enough to pay the debt, he must then sell back his leased spaces to the CA$INO BANK for the Broken Lease Value printed on the Lease Ownership Card 70. These spaces may then be leased to any player landing on the spaces during the course of play as if they had never been leased. If the above does not obtain sufficient chips 50 for the player to pay his debt, he may then obtain a loan of $500 in chips from the CHIP LOANER 121. The player advances his playing piece 30 to the space 121 and collects his loan from the CA$INO BANK. This is one time loan and does not need to be repaid. This is a different move from a routing landing on the space 121 wherein a landing player receives $25 in chips from the CA$INO BANK. The player may use the money to pay the rest of his debt and have a new stake in the game. Once a player uses his one time loan, he may not make another loan from the CHIP LOANER 121.

It is understood that the above-described embodiment is merely illustrative of the application. The basic teachings of the present invention have been described above. Many extensions and variations will be obvious to one having ordinary skill in the art. Many, if not all of the physical aspects of the game are flexible, i.e., number of spaces, dimensions, colors, etc. The number of game spaces may be increased or decreased. Other embodiments may be readily devised by those skilled in the art which will embody the principles of the invention and fall within the spirit and scope thereof.

I claim:

1. A game apparatus for one or more players, comprising:

a game board having a continuous path around its perimeter divided into consecutive marked spaces constituting a path of progression about the board and individually marking a playing position, a number of said spaces representing gambling properties, one group of which being uniquely marked and designated as leased casino game properties, each having a monetary value, said group being further subdivided into three subgroups of gambling properties, each of which designating a different type of gambling game, and a second group of said spaces being uniquely marked and designated as nonleased club properties, and the remaining spaces being designated for certain reward/penalty functions;

a plurality of playing pieces one for each of the game players, for movement by each player along said path of progression in accordance with the rules of the game, said playing pieces being of a size to fit within said marked spaces;

a plurality of special cards each of which associating with and uniquely indicating the lease ownership of a particular leased casino game property;

a manager's card associated with and uniquely indicating management of the said group of nonleased club properties;

a plurality of reward/penalty fortune cards associated with certain marked spaces which indicate varied reward/punishments, opportunities and/or directions in accordance with the rules of the game;

a random number generating means for determining the movement of each player's playing piece along the progression of spaces on the board and for determining the manager of said group of nonleased properties;

a plurality of special playing cards associated with two of said casino game properties subgroups thereby providing means for playing casino gambling games between a player whose playing piece comes to rest one of said subgroup leased casino game spaces and a player possessing a lease ownership card for said leased casino game space;

a special die associated with one of said casino game properties subgroups thereby providing means for playing a casino gambling game between a player whose playing piece comes to rest on one of said subgroup leased casino game spaces and a player possessing a lease ownership card for said leased casino game space;

a plurality of token money having various values for satisfying certain obligations or benefits derived from said casino gambling games and said reward/penalty functions, as well as providing a medium of payment for obtaining a leased casino game space;

means for measuring the amount of token money held by each player; and a games sheet describing the rules for each casino game.

2. A game apparatus as described in claim 1, wherein: said means for measuring the amount of token money held by each player is comprised of a plurality of letter cards for purchase by each game player, the first player obtaining a designated grouping of letter cards being determined the winner of a game.

3. A game apparatus as described in claim 2, wherein: said gambling properties unique markings are comprised of unique color indicia.

4. A game apparatus as described in claim 3, wherein: each said special card associated with and uniquely indicating lease ownership has a color indicia identical to the color indicia of the gambling property said card is associated with.

5. A game apparatus as described in claim 4, wherein: said nonleased club properties unique marking is comprised of a unique color indicia.

6. A game apparatus as described in claim 5, wherein: said manager's card has a color indicia identical to the color indicia of the nonleased club properties.

7. A game apparatus as described in claim 6 wherein: said grouping of letter cards is comprised of a plurality of letters to the word CA$INO.

8. A game apparatus as described in claim 7 wherein: said random number generating means is comprised of a pair of dice.

9. A game apparatus as described in claim 8 wherein: said token money is comprised of multicolored chips.

10. A game apparatus as described in claim 9 wherein: said casino games include CARDS, DICE and "22".

* * * * *